United States Patent [19]

Uyeda

[11] Patent Number: 4,470,277

[45] Date of Patent: Sep. 11, 1984

[54] SECURITY DOOR LOCKING MECHANISM

[75] Inventor: Tim M. Uyeda, South San Gabriel, Calif.

[73] Assignee: La Gard, Inc., Torrance, Calif.

[21] Appl. No.: 396,010

[22] Filed: Jul. 7, 1982

[51] Int. Cl.[3] ..... E05B 63/14

[52] U.S. Cl. ..... 70/118; 70/284; 292/34; 292/36

[58] Field of Search ..... 70/284, 339, 114–120; 292/36, 34, 159, 170

[56] References Cited

U.S. PATENT DOCUMENTS

| | | | |
|---|---|---|---|
| 129,052 | 7/1872 | Pigot | 70/118 |
| 1,113,193 | 10/1914 | Carroll | 70/284 |
| 1,437,561 | 12/1922 | Shively | 70/284 |
| 1,558,080 | 10/1925 | Fouts | 70/118 |
| 1,673,468 | 6/1928 | Palinkas | 70/120 |
| 1,966,171 | 7/1934 | Holtzman | 70/116 X |
| 2,094,369 | 9/1937 | Millice | 70/118 X |
| 2,787,154 | 4/1957 | Wesberry | 70/118 |
| 2,860,584 | 11/1958 | Deaton et al. | 292/36 X |
| 4,147,044 | 4/1979 | Bernath | 292/36 X |

FOREIGN PATENT DOCUMENTS

| | | | |
|---|---|---|---|
| 783618 | 7/1935 | France | 70/118 |

*Primary Examiner*—Thomas J. Holko
*Assistant Examiner*—Thomas J. Dubnicka
*Attorney, Agent, or Firm*—Poms, Smith, Lande & Rose

[57] ABSTRACT

A locking mechanism for security doors such as safes. A mounting plate is provided for attachment to the inner surface of the door. A cylindrical activating member is mounted on a pin for rotation about an axis normal to the inner surface of the door. The activating member contains a plurality of activating fingers and mounting posts for connecting to locking pin actuating mechanisms directly or through linkages. A groove is provided in the periphery of the activating member. A pair of sliding members are mounted to the plate. One sliding member is positioned to slide into the groove to prevent rotation of the activating member. The second sliding member is adapted to slide into abutment with the first member to prevent sliding thereof. Standard lock mechanisms of the combination or pin tumbler type for use with a key are mounted to the plate and connected to the two sliding members to control their movement.

15 Claims, 19 Drawing Figures

Fig. 2.
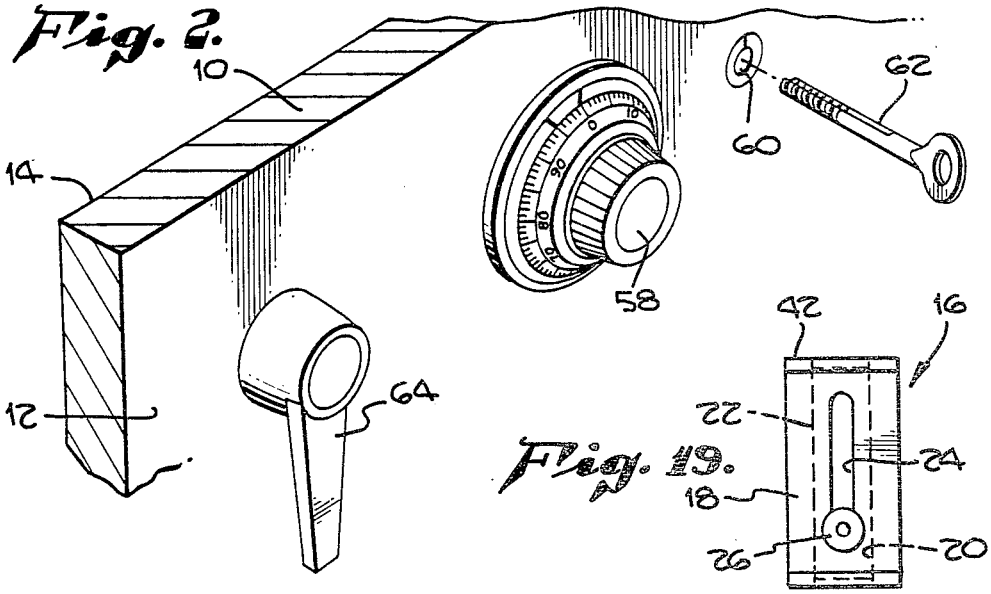
Fig. 19.
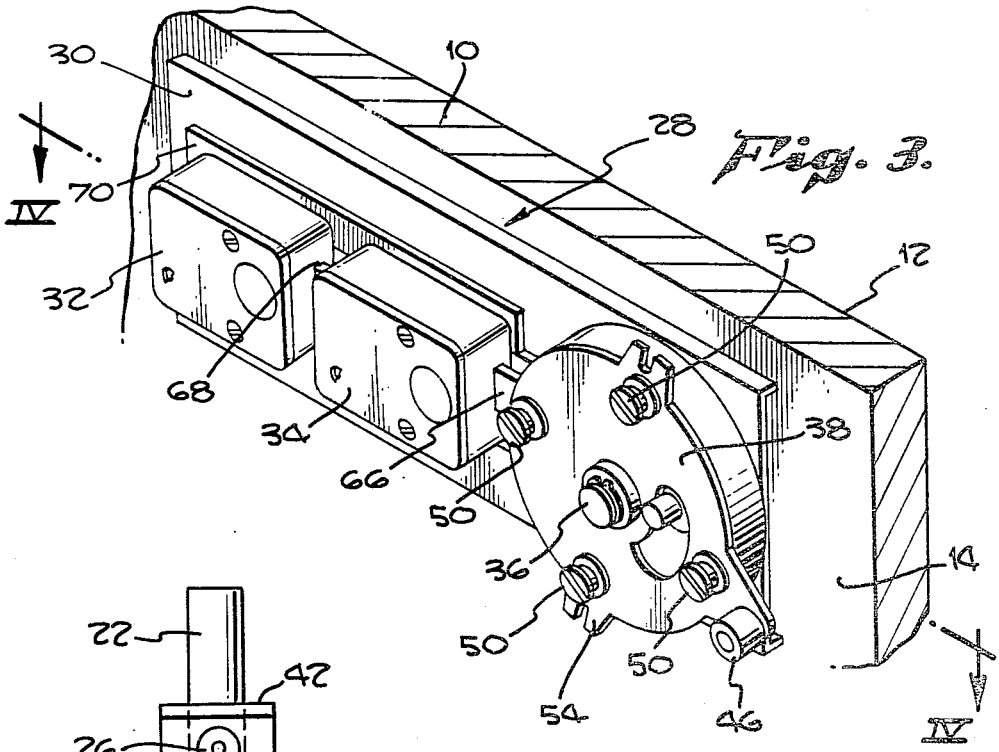
Fig. 3.
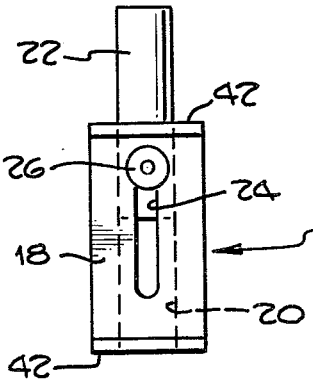
Fig. 18.

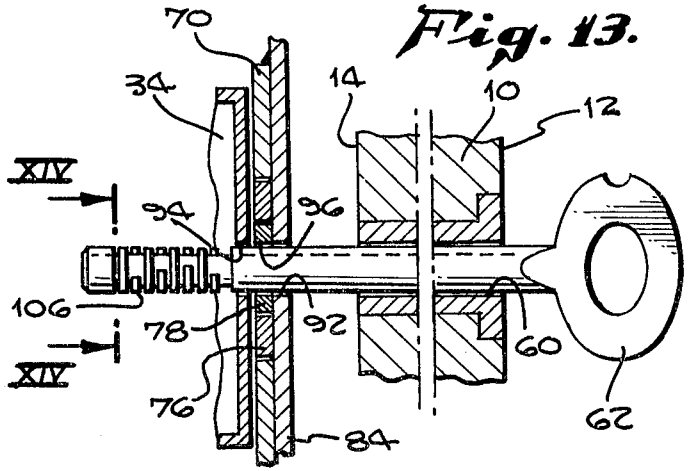
Fig. 13.
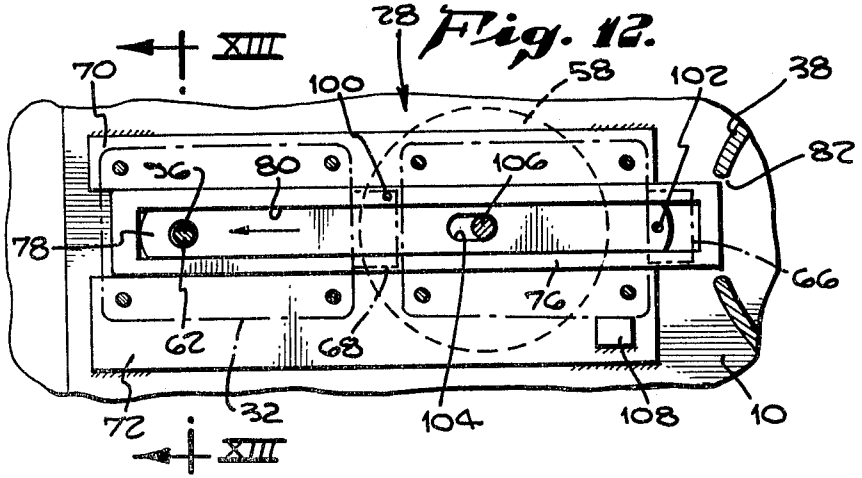
Fig. 12.
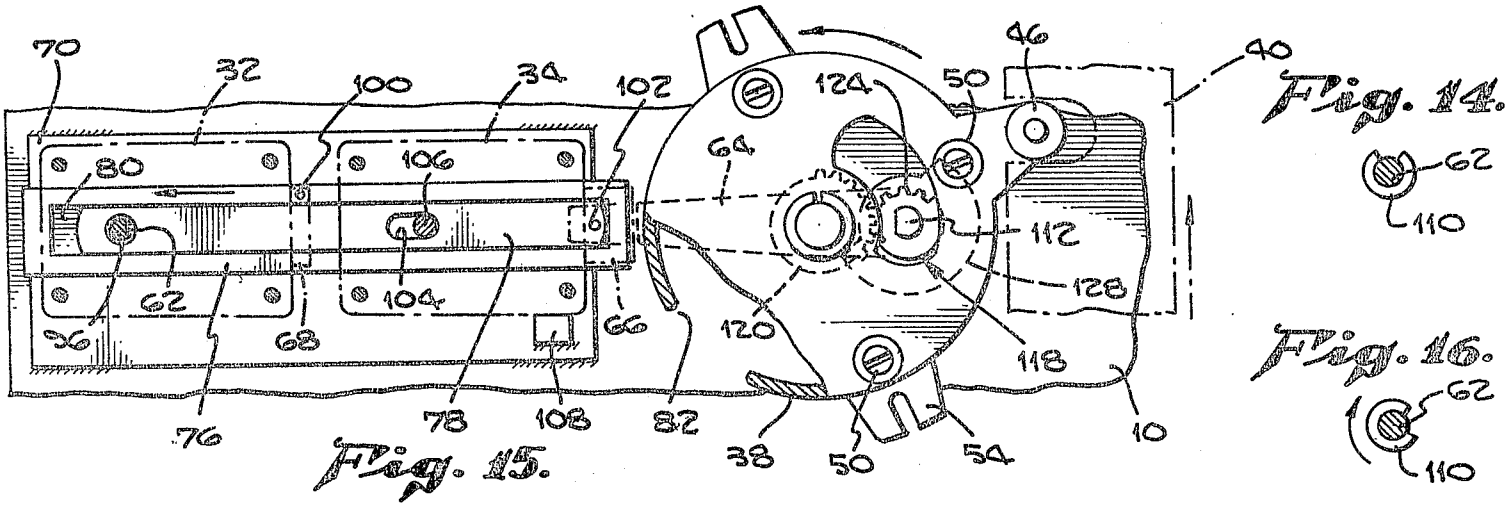
Fig. 14.
Fig. 15.
Fig. 16.

SECURITY DOOR LOCKING MECHANISM

BACKGROUND OF THE INVENTION

The present invention relates to locks for security doors and, more particularly, to locking mechanisms of the type used to secure safe doors.

In the prior art, the building of a combination and/or key-operated safe door has required persons with specialized training. The door itself has been no problem, it is merely welded together by anyone skilled in the art. The mounting and integration of the locking mechanism, however, is another story. The lock mechanism is first mounted to the inner portion of the door and then the operating mechanism is specially constructed for each particular door. Each shape, of the door takes individual consideration. Therefore, each safe door is a custom product. As with most custom products made on an individual basis, the cost thereof is very high.

Therefore, it is the object of the present invention to provide a locking mechanism of a general nature which can be attached to the inside of any door to operate retractable pins disposed about the edge thereof to turn the door into a security door.

SUMMARY

The foregoing objective has been met by the lock mechanism of the present invention for a security door having a plurality of movable bolts adjacent the inner edge comprising an activating member attached to the inner surface of the door for rotation about an axis normal to the inner surface; linkage means operably connected between the activating member and bolts for moving the bolts into position to lock the door when the activating member is rotated in one direction and for moving the bolts out of their locking position when the activating member is rotated in the opposite direction; first locking means operably connected for releasably engaging the activating member to prevent rotation thereof; second locking means operably connected for releasably engaging the first locking means to prevent movement thereof whereby the second locking means must be released before the first locking means can release the activating member; means operably connected for rotating the activating member from outside the door; means operably connected for operating the first locking means; and means operably connected for operating the second locking means.

In the preferred embodiment, the activating member has a slot at the periphery thereof; the first locking means comprises a first sliding member adapted to slide into and out of the slot; and, the second means comprises a second sliding member adapted to slide into and out of engagement with an abutting surface of the first sliding member.

Additionally, in the preferred embodiment, the means for operating the first locking means is a removable means and the second locking means includes means for preventing the means for operating the first locking means from being operably connected to the first locking means when the second locking means is engaged with the abutting surface.

DESCRIPTION OF THE DRAWINGS

FIG. 2 is a perspective view of the outside portion of the door showing the opening handle, combination dial, and key slot and key used in conjunction with the present invention.

FIG. 3 is a perspective view showing the activating member and two locking members of the present invention.

FIG. 12 is an elevation view of the locking mechanism showing the first mechanism open and the second mechanism closed.

FIG. 13 is a cutaway through the mechanism of FIG. 12 in the plane XIII—XIII.

FIG. 14 is a cutaway view through the key of FIG. 13 in the plane XIV—XIV.

FIG. 15 is an elevation view of the locking mechanism in its completely open position to allow the activating member to rotate.

FIG. 16 is a view of the key of FIG. 13 in the plane XIV—XIV being rotated.

FIG. 18 is a front elevation of a slide bolt in its extended position.

FIG. 19 is a front elevation of a slide bolt in its retracted position.

DESCRIPTION OF THE PREFERRED EMBODIMENT

Figure 1:
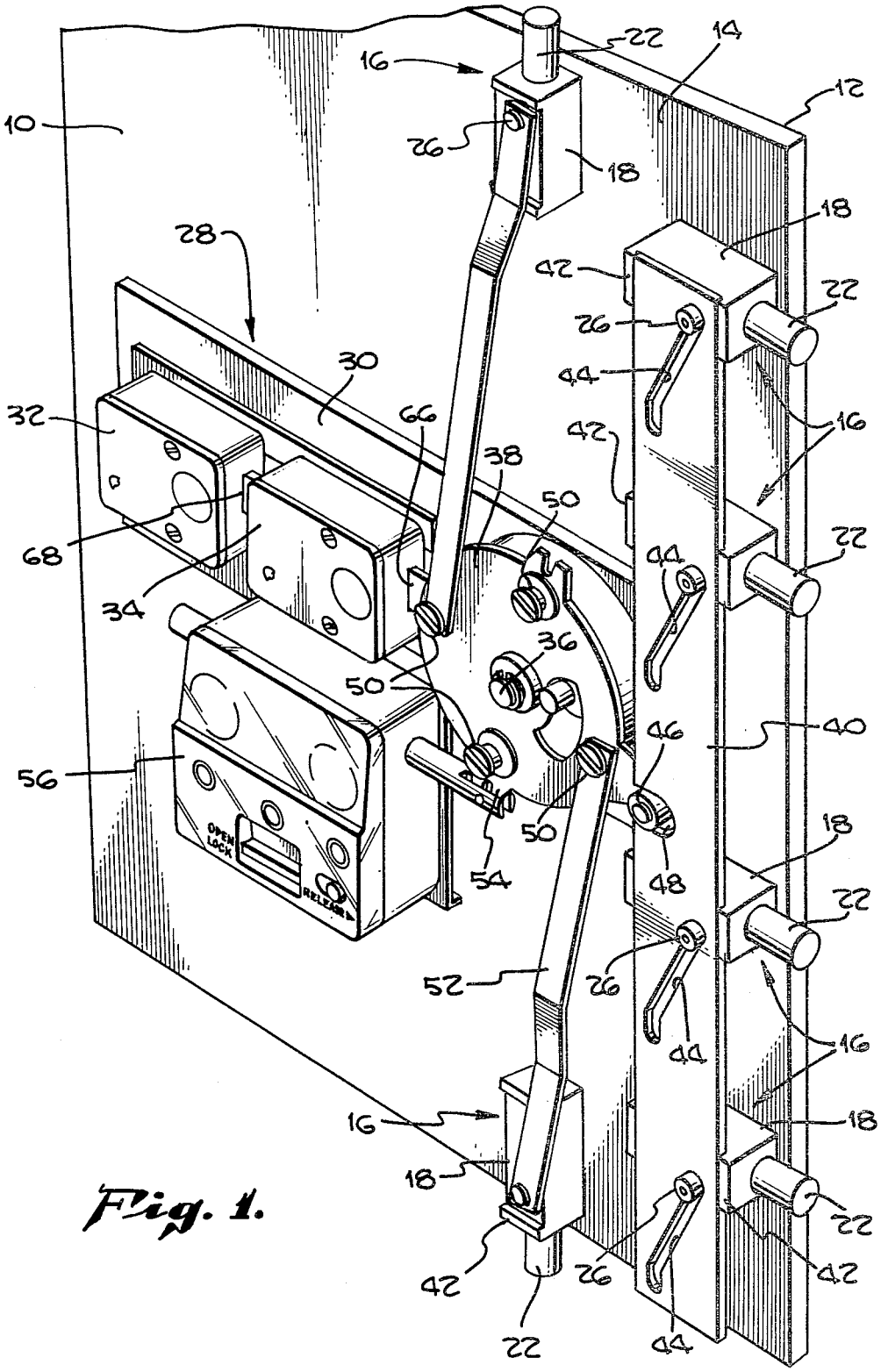
FIG. 1 is a perspective view of the locking mechanism of the present invention attached to a security door.

Referring first to FIGS. 1, 18 and 19, the locking mechanism of the present invention is shown incorporated on a safe or security door. The door is generally indicated as 10 and has an outside surface 12 and inside surface 14. A number of slide bolts 16 of the type shown in FIGS. 18 and 19 are attached as by welding along the inner edge of the door 10. As can be seen in the more detailed drawings of FIGS. 18 and 19, the slide bolts 16 comprise a housing 18 having a longitudinal bore 20 therethrough. A cylindrical bolt 22 is disposed within the bore 20. A slot 24 is cut through the outer surface of the housing 18 to communicate with the bore 20. Operating pin 26 passes through the slot 24 and is affixed to the bolt 22. By sliding the operating pin 26 to one extreme of the slot as shown in FIG. 18, the bolt 22 can be extended to lock the door 10. By sliding the operating pin 26 to the opposite end of slot 24, the bolt 22 can be withdrawn to unlock the door 10.

The locking mechanism of the present invention is generally indicated as 28. Mechanism 28 comprises a back plate 30 attached to the inner surface 14 of the door 10 as by welding. A pair of locks 32, 34 are mounted to the back plate 30. Back plate 30 has a pin 36 extending normal thereto on which is mounted a cylindrical activating member 38. Activating member 38 can be rotated clockwise and counter-clockwise about the pin 36 by a handle (not shown at this point) on the outside of the door 10. The locks 32, 34 operate in tandem from outside the door in a manner to be described in detail hereinafter so as to lock the activating member 38 from rotation.

As can easily be seen in the drawings, the activating member 38 is adapted for ready connection to a variety of operating linkages for the slide bolts 16. For example, along the vertical edge of the door 10, the four slide bolts 16 are mounted in vertical alignment. A slide bar 40 is mounted between the guide tabs 42 of the respective housings 18. The slide bar 40 contains an angled slot 44 operably disposed over each operating pin 26. As will be readily recognized by those skilled in the art, this is a standard approach which will cause the four bolts 22 to be extended in the same manner shown when the bar 40 is in its lower position and to be retracted simultaneously when the slide bar 40 is raised. Activating member 38 is provided with an operating roller post 46 disposed within slot 48 provided in the slide bar 40 therefor. Consequently, as the activating member 38 is rotated in a clockwise direction, post 46 will force slide bar 40 in the downward direction extending the bolts 22. When the activating member 38 is rotated in a counter-clockwise direction, the post 46 will raise the slide bar 40, thus retracting the bolts 22.

Activating member 38 is also provided with posts 50 to which individual linkages 52 can be attached on one end and connected to the operating pin 26 of a slide bolt 16 on the opposite end as shown in FIG. 1 with respect to the single top and bottom bolts. Activating member 38 also contains auxillary drive tabs 54 for use in conjunction with other devices such as the timer 56.

The unique locking mechanism of the present invention will now be described in greater detail. The basic manner of operation is shown in FIGS. 2 and 3. The outside surface 12 of door 10 is provided with a combination dial 58, a key-slot or hole 60 into which key 62 can be inserted, and an operating handle 64. The locks 32, 34 operate in tandem to secure the activating member 38. Lock 32 is operated by the key 62 and lock 34 is operated by the combination dial 58. With the door 10 in a fully locked condition, the key 62 cannot be inserted into the keyslot 60. Upon successful manipulation of the combination dial 58, the bolt 66 of lock 34 is retracted which opens the keyslot 60 for the insertion of key 62. Upon the insertion of key 62 and the turning thereof to activate lock 32, the bolt 68 thereof is retracted which, in turn, releases the activating member 38 for rotation. The handle 64 can then be turned to rotate the activating member 38 to open the lock mechanism. As will be seen and recognized in the description which follows hereinafter, the locks 32, 34 are of a generally available standard commercial variety with only minor modification to the bolts 66, 68 thereof being required for them to be incorporated within the locking mechanism 28 of the present invention. For that reason, both locks 32 and 34 could comprise combination locks or, conversely, both locks 32, 34 could comprise key-operated locks. One or both of locks 32, 34 could also employ other types of locks such as magnetically-operated locks. All that is required is that the lock 32 and 34 have some form of extending and retracting bolts 68, 66, or the like, respectively.

Attention is now directed to FIGS. 4–9 wherein the locking mechanism 28 is shown in greater detail in its completely locked state. The back plate 30 has a pair of guide bars 70, 72 welded thereto in parallel spaced relationship. The locks 32, 34 are attached to the guide bars 70, 72 by the bolts 74. A pair of sliders 76, 78 are disposed between the guide bars 70, 72. Slider 76 is an outer slider having a slot 80 therein with parallel sides. Slider 78 is an inner slider disposed within slot 80. While the guide bars 70, 72 and sliders 76, 78 being described herein with respect to a tested embodiment of the present invention have straight sides, those skilled in the art will easily recognize that the novel features of the present invention could also be accomplished by making the guide bars 70, 72 and sliders 76, 78 in the form of circular segments for arcuate rather than linear motion. It should be further recognized that whereas two locks 32, 34 are employed with two sliders 76, 78, additional locks could be added in tandem. In that case, outer slider 76 would be an inner slider of yet another slider with a third lock disposed to operate that slider.

Figure 4:
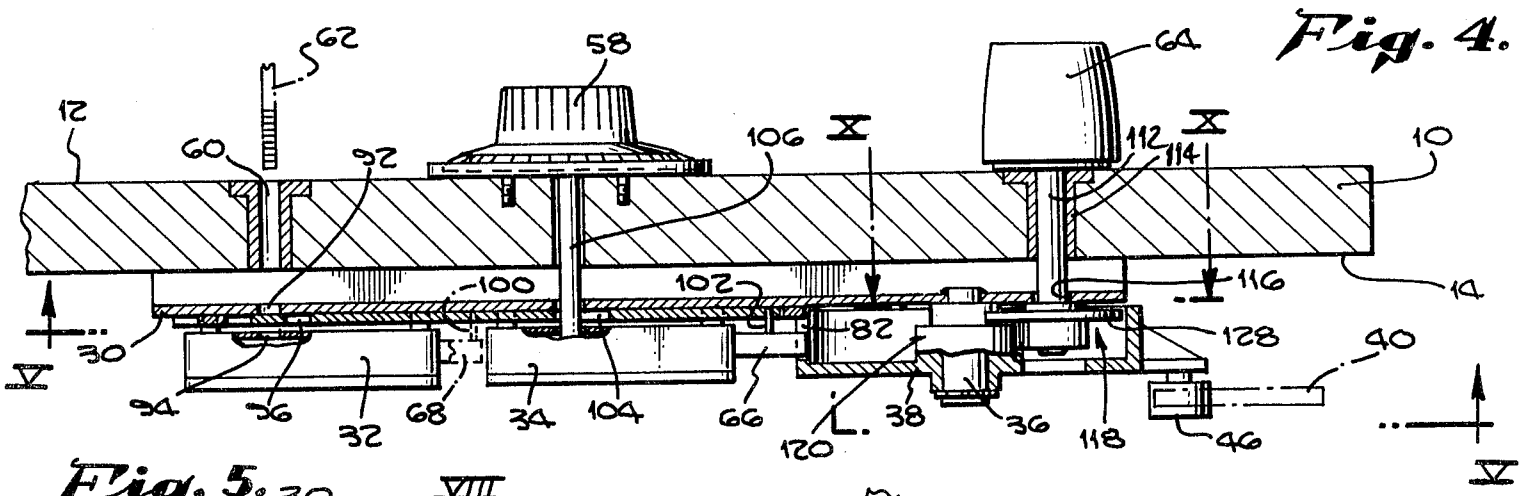
FIG. 4 is a cutaway plan view of FIG. 3 in the plane IV—IV.
Figure 5:
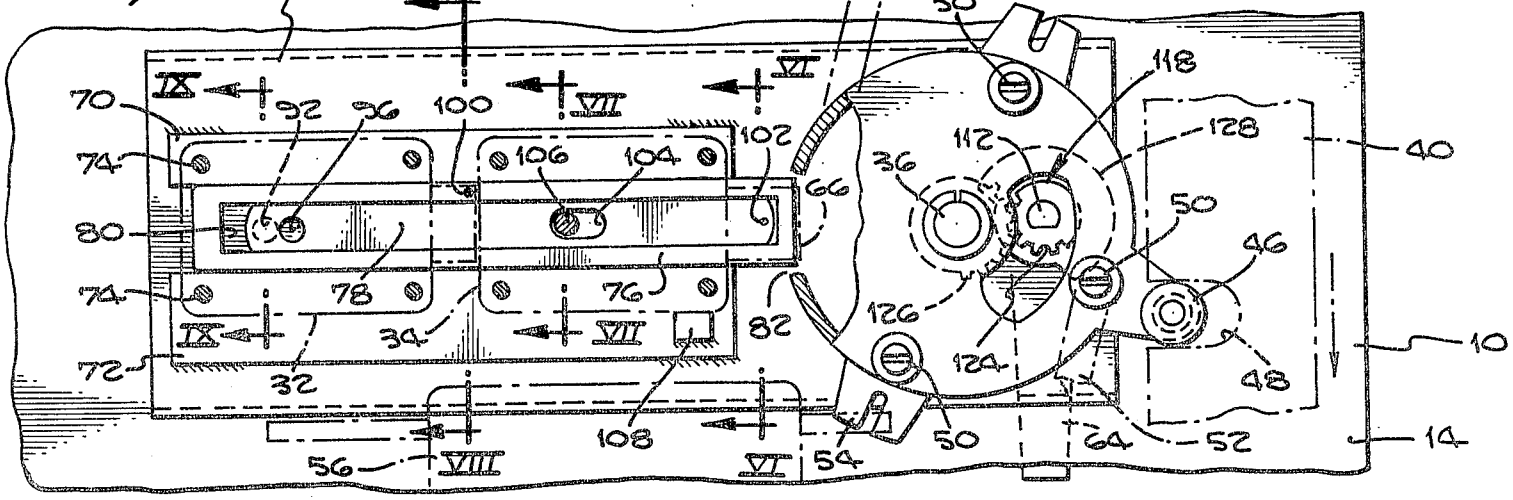
FIG. 5 is a partially-cutaway elevation of the locking mechanism of FIG. 4 in the plane V—V.
Figure 6:
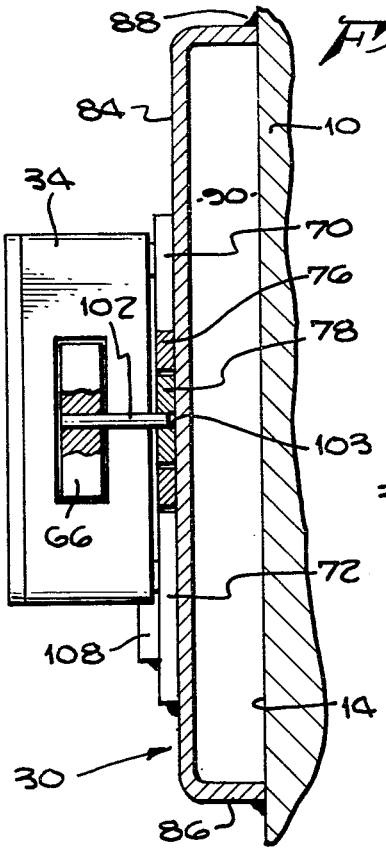
FIG. 6 is a cutaway drawing of the mechanism of FIG. 5 in the plane VI—VI.
Figure 7:
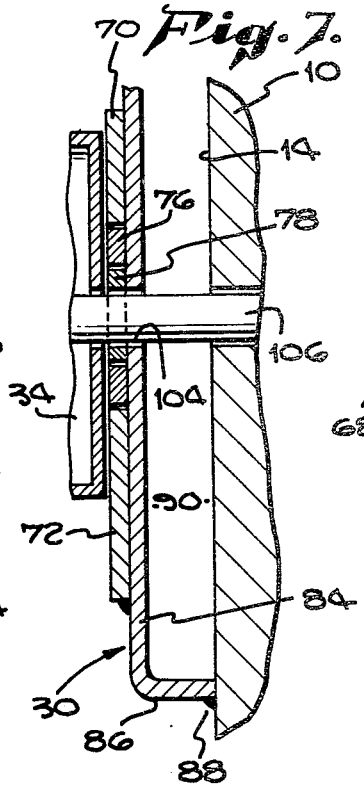
FIG. 7 is a cutaway view through the mechanism of FIG. 5 in the plane VII—VII.
Figure 8:
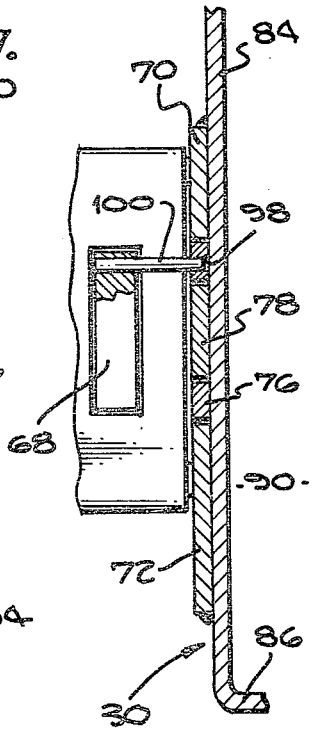
FIG. 8 is a cutaway view through the mechanism of FIG. 5 in the plane VIII—VIII.
Figure 10:
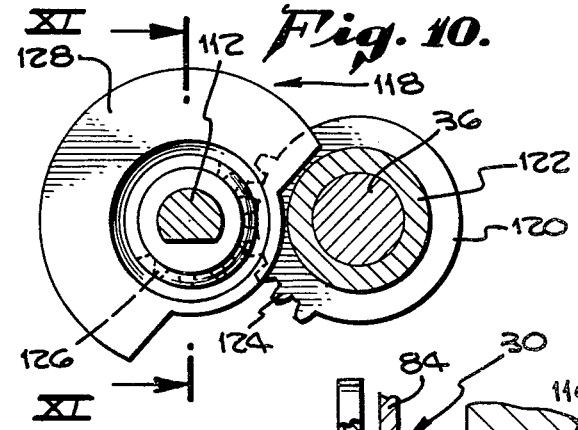
FIG. 10 is a detailed drawing of the mechanism whereby the handle is used to rotate the operating mechanism.
Figure 11:
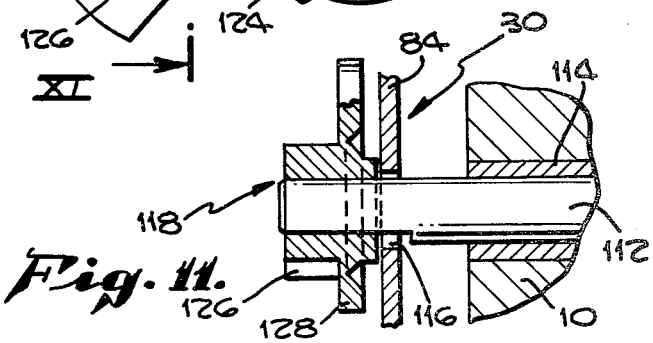
FIG. 11 is a cutaway view of the mechanism of FIG. 10 in the plane XI—XI.
Figure 9:
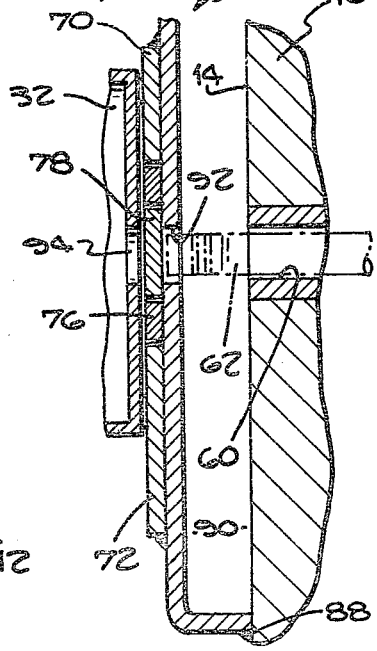
FIG. 9 is a cutaway view through the mechanism of FIG. 5 in the plane IX—IX.
Figure 17:
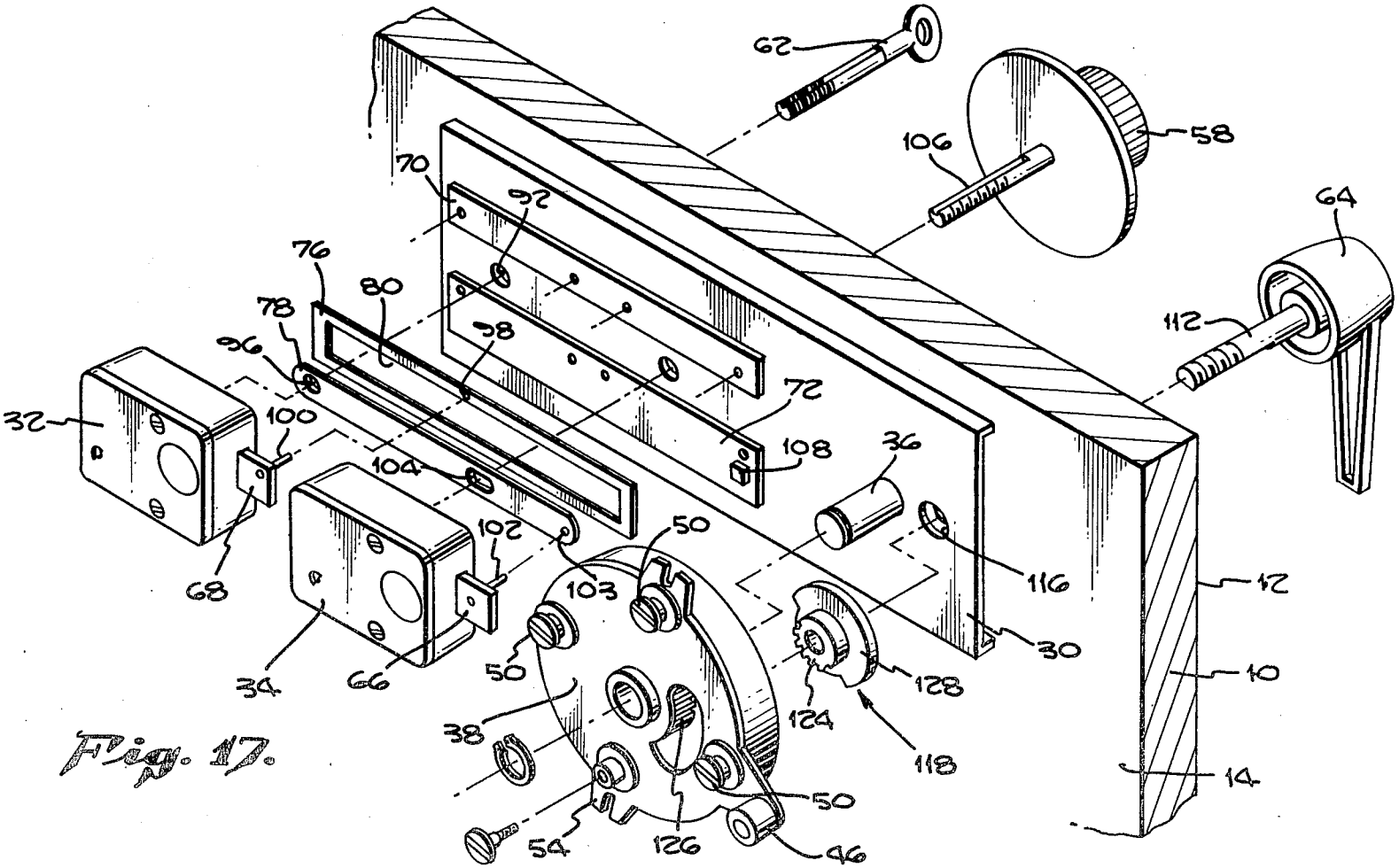
FIG. 17 is an exploded view of the locking mechanism of the present invention.

The actuating member 38 contains a slot 82 in its outer periphery. The outer slider 76 is sized to slide into the slot 82. The inner slider 78 is not as long as the slot 80 of outer slider 76. As a consequence, inner slider 78 can be slid to either end of the slot 80. In its position as shown in FIG. 5, the inner slider 78 is in abutment with the inner end of the slot 80 of outer slider 78 to, thereby, prevent retraction of the outer slider 76 from within the slot 82 of the activating member 38. It should be noted at this point that the back plate 30 comprises a vertical member 84 and horizontal members 86 which are welded as at 88 to the inner surface 14 of door 10. Thus, a space 90 is created between the inner surface 14 of the door 10 and the vertical member 84 into which a hard plate (not shown) can be placed. The vertical member 84 has a hole 92 in alignment with the keyhole 60. Both are in alignment with the entry hole 94 of lock 32. As can be seen, however, the inner slider 78 has a hole 96 therein which is out of alignment with hole 92 when slider 78 is in its locked position extended as shown in FIG. 5. As a consequence, the key 62 cannot be inserted into the lock 32 but, rather, abuts against inner slider 76 in the manner shown in FIG. 9. The outer slider 78 is provided with a hole 98 which is best seen in FIG. 17 and is connected to the bolt 68 of lock 32 by a rollpin 100 positioned partially in the hole as seen in FIGS. 4 and 5. As a consequence, when bolt 68 is extended from lock 32, the outer slider 76 is extended into slot 82 of the actuating member 38 as shown in FIG. 5. In like manner, the inner slider 78 contains a hole 103 which is best seen in FIG. 17 and is connected to bolt 66 of lock 34 by a rollpin 102. Inner slider 78 also contains a slot 104 through which the operating shaft 106 between the combination dial 58 and the lock 34 can pass and allow the inner slider 78 to move between its extended and retracted positions. A stop 108 is welded to the lower guide bar 72 to support lock 34 adjacent the slot 82 such that if an attempt is made to force the lock, the force will be transmitted to the case of the lock 34 and from thence to the stop 108 rather than being born by the bolts 74 entirely.

Turning now to FIG. 12, the first stage of opening the lock 28 of the present invention is shown. Upon successful manipulation of the combination dial 58, the bolt 66 of lock 34 is withdrawn into the lock 34. In so doing, rollpin 102 moves the inner slider 78 to the left as FIG. 12 is viewed. This places hole 96 in alignment with hole 92 and keyhole 60. The key 62 can now be inserted into operable engagement with the lock 32. This is shown in FIG. 13. As can be seen in FIG. 14, a typical key contains a plurality of arcuate sections 110 which are placed into operable engagement with the mechanism of the lock 32 when the key 62 is inserted therein. As the key is rotated, the arcuate sections rotate as shown in FIG. 16. This causes the final stage of unlocking of the lock mechanism 28 to occur. As shown in FIG. 15, as the key 62 is rotated in the manner of FIG. 16, its bolt 68 is retracted into lock 32. Its rollpin 100 thereupon slides the outer slider 76 to the left as FIG. 15 is viewed which, in turn, retracts it out of the slot 82 of the activating member 38. Activating member 38 can then be rotated to open the various locking mechanisms operably connected thereto. One principal advantage of the present locking mechanism is that the key can be used for convenience to open and close the locking mechanism 28 throughout the working day but complete security can be accomplished by a quick rotation of the combination dial to effect the double locking.

Turning now to FIGS. 4, 5, 10, 11, and 17 with particularity, the components for rotating the activating member 38 will be discussed in detail. A shaft 112 extends from the handle 64 and passes through a sleeve bearing 114 in door 10 provided to allow the handle 64 and shaft 112 to be rotated without binding. Shaft 112 passes through a hole 116 in the back plate 30 adjacent pin 36. A drive gear assembly 118 is connected on the inner end of shaft 112. The inner hub 120 of activating member 38 has a bearing 122 which surrounds the pin 36, again to allow non-binding movement. Inner hub 120 has a spur gear segment 124 which meshes with a corresponding spur gear segment 126 on the drive gear assembly 118. Drive gear assembly 118 is also provided with an arcuate stop ring 128 which abuts against the inner hub 120 at either end of the desired arc of travel of the activating member 38 to prevent further movement thereof.

Wherefore, having thus described my invention, I claim:

1. A lock mechanism for a security door having a plurality of movable bolts adjacent the inner edge comprising:

(a) an activating member attached to the inner surface of the door for rotation about an axis normal to said inner surface wherein said activating member has a slot at the periphery thereof;

(b) linkage means operably connected between said activating member and the bolts for moving the bolts into position to lock the door when said activating member is rotated in one direction and for moving the bolts out of their locking position when said activating member is rotated in the opposite direction;

(c) first locking means operably connected for releasably engaging said activating member to prevent rotation thereof wherein said first locking means comprises a first sliding member adapted to slide into and out of said slot;

(d) second locking means operably connected for releasably engaging said first locking means to prevent movement thereof whereby said second locking means must be released before said first locking means can release said activating member, said second locking means comprising a second sliding member adapted to slide into and out of engagement with an abutting surface of said first sliding member;

(e) means operably connected for rotating said activating member from outside the door;

(f) means operably connected for operating said first locking means from outside the door; and (g) means operably connected for operating said second locking means from outside the door.

2. The lock mechanism of claim 1 wherein:

(a) said means for operating said first locking means is a removable means; and, (b) said second locking means includes means for preventing said means for operating said first locking means from being operably connected to said first locking means when said second locking means is in engagement with said abutting surface.

3. The lock mechanism of claim 1 wherein:

said activating member contains a plurality of means for operably connecting said member to linkages whereby the lock mechanism can be used in different doors with modification of only the linkages.

4. The lock mechanism of claim 1 wherein:

said activating member comprises a cylindrical member having a plurality of engaging members extending radially outward from the periphery for engaging and sliding sliding members as said activating member is rotated and a plurality of mounting means on the inner surface for releasably mounting linkages for rotation about axes normal to the door.

5. In a lock mechanism for a security door having an activating member adapted for movement from outside the door to bolt and unbolt the door, the improvement comprising:

(a) first locking means for releasably engaging the activating member to prevent movement thereof, said first locking means comprising a first sliding member adapted to slide into and out of engagement with the activating member;

(b) second locking means for releasably engaging said first locking means to prevent movement thereof whereby said second locking means must be released before said first locking means can release said activating member, said second locking means comprising a second sliding member adapted to slide into and out of engagement with an abutting surface of said first sliding member;

(c) means for operating said first locking means from outside the door; and, (d) means for operating said second locking means from outside the door.

6. The improvement to a lock mechanism of claim 5 wherein:

(a) said means for operating said first locking means is a removable means; and, (b) said second locking means includes means for preventing said means for operating said first locking means from being operably connected to said first locking means when said second locking means is in engagement with said abutting surface.

7. A locking assembly for releasably engaging a member to prevent movement thereof comprising:

(a) a support plate adapted to be mounted adjacent the members;

(b) a first slider carried by said support plate for sliding movement between a first position engaged with the member to prevent movement thereof and a second position disengaged from the member and wherein said first slider has a slot therein;

(c) a second slider carried by said support plate for sliding movement between a first position in abutment with said first slider and holding said first slider in its said first position and a second position out of abutment with said first slider wherein said second slider is disposed in said slot and said first slider is free to move between its said first and second positions; and, (d) means carried by said support plate for moving said slider between and for holding said sliders in said positions.

8. The locking assembly of claim 7 wherein:

(a) said support plate includes a pair of parallel, spaced, guide bars;

(b) said first slider is disposed between said guide bars to be supported for sliding movement thereby; and, (c) said moving and holding means is disposed across said guide bars to hold said sliders against said support plates.

9. A locking assembly for releasably engaging a member to prevent movement thereof comprising:

a support plate adapted to be mounted adjacent the members;

a first slider carried by said support plate for sliding movement between a first position engaged with the member to prevent movement thereof and a second position disengaged from the member;

a second slider carried by said support plate for sliding movement between a first position in abutment with said first slider and holding said first slider in its said first position and a second position out of abutment with said first slider wherein said first slider is free to move between its said first and second positions; and means carried by said support plate for moving said slider between and for holding said sliders in said positions wherein: said moving and holding means each comprises a lock mechanism with a extending and retracting lock bolt and said lock bolts are connected to respective ones of said sliders to move in combination therewith.

10. The locking assembly of claim 9 wherein:

(a) said support plate includes a pair of parallel, spaced, guide bars;

(b) said first slider is disposed between said guide bars to be supported for sliding movement thereby; and, (c) said lock mechanisms are disposed across said guide bars to hold said sliders against said support plate; and, (d) said lock bolts are connected to said sliders by a pin passing through each said lock bolt and its associated respective one of said sliders rigidly connecting them together.

11. A universal lock bolt actuating mechanism for use in a security door comprising:

(a) a support plate adapted to be mounted to a security door having slidable lock bolts thereon, said support plate including a pin extending normal to the surface of said plate;

(b) an activating member mounted on said pin for rotation, said activating member including a plurality of means for operably and removably connecting said member to one end of linkages operably connected on the other end to the lock bolts on the security door whereby the lock mechanism can be used in different doors with modification of only the linkages;

(c) means for rotating said activating member; and (d) means for locking said activating member against rotation wherein said locking means comprises: a first slider carried by said support plate for sliding movement between a first position engaged with said activating member to prevent rotation thereof and a second position disengaged from said activating member; a second slider carried by said support plate for sliding movement between a first position in abutment with said first slider and holding said first slider in said first position and a second position out of abutment with said first slider wherein said first slider is free to move between its said first and second positions; and, means carried by said support plate for moving said sliders between and for holding said sliders in said positions.

12. The universal lock bolt activating mechanism of claim 11 wherein:

(a) said first slider has a slot therein; and, (b) said second slider is disposed in said slot.

13. The universal lock bolt activating mechanism of claim 12 wherein:

(a) said support plate includes a pair of parallel, spaced, guide bars;

(b) said first slider is disposed between said guide bars to be supported for sliding movement thereby; and, (c) said moving and holding means is disposed across said guide bars to hold said sliders against said support plate.

14. The universal lock bolt activating mechanism of claim 12 wherein:

(a) said moving and holding means each comprises a lock mechanism with an extending and retracting lock bolt; and, (b) said lock bolts are connected to respective ones of said sliders to move in combination therewith.

15. The universal lock bolt activating mechanism of claim 14 wherein:

(a) said support plate includes a pair of parallel, spaced, guide bars;

(b) said first slider is disposed between said guide bars to be supported for sliding movement thereby;

(c) said lock mechanisms are disposed across said guide bars to hold said sliders against said support plate; and, (d) said lock bolts are connected to said sliders by a pin passing through each said lock bolt and its associated respective one of said sliders rigidly connecting them together.

* * * * *